US007454897B2

(12) United States Patent
Mizuguchi

(10) Patent No.: US 7,454,897 B2
(45) Date of Patent: Nov. 25, 2008

(54) EXHAUST PURIFIER FOR DIESEL ENGINE

(75) Inventor: Keiichi Mizuguchi, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 0 days.

(21) Appl. No.: 11/503,740

(22) Filed: Aug. 14, 2006

(65) Prior Publication Data

US 2007/0039314 A1 Feb. 22, 2007

(30) Foreign Application Priority Data

Aug. 18, 2005 (JP) ..... 2005-237644

(51) Int. Cl.
*F01N 3/00* (2006.01)

(52) U.S. Cl. ..... 60/285; 60/278; 60/286; 60/295; 60/297; 60/311

(58) Field of Classification Search ..... 60/278, 60/280, 285, 286, 295, 297, 303, 311
See application file for complete search history.

(56) References Cited

U.S. PATENT DOCUMENTS 4,835,964 A 6/1989 Kume et al.
6,574,956 B1 * 6/2003 Moraal et al. ..... 60/295
6,978,602 B2 * 12/2005 Ohtake et al. ..... 60/295
7,036,305 B2 * 5/2006 Nishimura ..... 60/286
7,062,906 B2 * 6/2006 Otake et al. ..... 60/295
7,082,754 B2 * 8/2006 Otake et al. ..... 60/295
7,246,485 B2 * 7/2007 Ohki et al. ..... 60/285

FOREIGN PATENT DOCUMENTS

| | | |
|---|---|---|
| EP | 0 893 590 A2 | 1/1999 |
| EP | 1 146 216 A2 | 10/2001 |
| JP | 2000-234553 | 8/2000 |
| JP | 2004-286026 | 10/2004 |
| JP | 2005-016396 | 1/2005 |

OTHER PUBLICATIONS

European Search Report dated Jun. 23, 2008 issued by European Patent Office for application No. 06118740.7-1263/1754876.

* cited by examiner

*Primary Examiner*—Binh Q Tran
(74) *Attorney, Agent, or Firm*—Morgan & Finnegan, LLP

(57) ABSTRACT

A controller for an exhaust purifier performs idle-up to increase the idle speed of a diesel engine when an intake air amount, which is based on the atmospheric pressure and the engine speed, is less than a reference air amount of when a throttle valve is completely open and an EGR valve is completely closed during the regeneration of the filter. The controller performs idle-up by increasing the amount of fuel injected from the fuel injection valves of the diesel engine.

11 Claims, 4 Drawing Sheets

EXHAUST PURIFIER FOR DIESEL ENGINE

BACKGROUND OF THE INVENTION

The present invention relates to an exhaust purifier for a diesel engine.

The exhaust gas (hereinafter referred to as "exhaust") emitted from a diesel engine contains particulate matter (hereinafter referred to as PM). The use of a particulate filter (hereinafter referred to as filter) in an exhaust system for elimination of the PM is well known in the prior art. However, deposition of the PM clogs the filter and lowers the output of the diesel engine. In order to resolve the problem of PM deposition, the filter is heated to a predetermined temperature (approximately 650° C. (hereinafter referred to as regeneration temperature)) to oxidize (burn) the PM deposited in the filter and regenerate the filter.

The amount of air actually drawn into the engine decreases at high altitudes due to the low air density. In such a case, the amount of fuel injected into the engine is controlled so as to be reduced. This lowers the temperature of the exhaust. Thus, the exhaust purifier may not be sufficiently heated. Japanese Laid-Open Patent Publication No. 2005-016396 describes a technique for solving such a problem in which the intake air amount is increased when driving a vehicle from a low altitude to a high altitude.

Generally, the idle speed of an eight cylinder engine is lower than that of a four cylinder engine to improve fuel efficiency. However, when driving the vehicle while regenerating the exhaust purifier, if the engine starts to idle, the intake air decreases. As a result, for example, the balance between the heat generated by PM combustion and the heat absorbed by air cannot be maintained thereby causing overshoot (hereinafter referred to as deceleration OT). Thus, at least a predetermined amount of intake air must be ensured when controlling the temperature increase of the filter.

In a gasoline engine, a predetermined amount of intake air is ensured by widely opening the throttle valve. In a diesel engine, the necessary quantity of intake air is ensured even when the idle speed is lowered as long as the engine is running under a normal pressure environment. However, under a low pressure environment, the intake air amount may not be ensured even by correcting the opening of the throttle valve.

SUMMARY OF THE INVENTION

The present invention provides an exhaust purifier for a diesel engine that ensures a predetermined amount of intake air amount when the filter temperature increase control is being executed under a low pressure environment.

One aspect of the present invention is an exhaust purifier for a diesel engine having an exhaust passage. The exhaust purifier includes a filter arrangeable in the exhaust passage of the diesel engine. A first detector detects atmospheric pressure. A controller controls the engine speed of the diesel engine. A second detector detects the engine speed of the diesel engine. The controller compares an intake air amount, which is based on the atmospheric pressure detected by the first detector and the engine speed detected by the second detector, with a reference air amount during regeneration of the filter. The controller performs idle-up for increasing the idle speed of the diesel engine when the intake air amount is less than the reference air amount.

A further aspect of the present invention is an exhaust purifier for a diesel engine having an exhaust passage. The exhaust purifier includes a filter arranged in the exhaust passage of the diesel engine. A first detector detects atmospheric pressure. A controller controls the engine speed of the diesel engine. A second detector detects the engine speed of the diesel engine. The controller compares the atmospheric pressure detected by the first detector with a reference pressure during regeneration of the filter. The controller performs idle-up for increasing the idle speed of the diesel engine when the atmospheric pressure is less than the reference pressure.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be described with reference to FIGS. 1 and 2.

Figure 1:
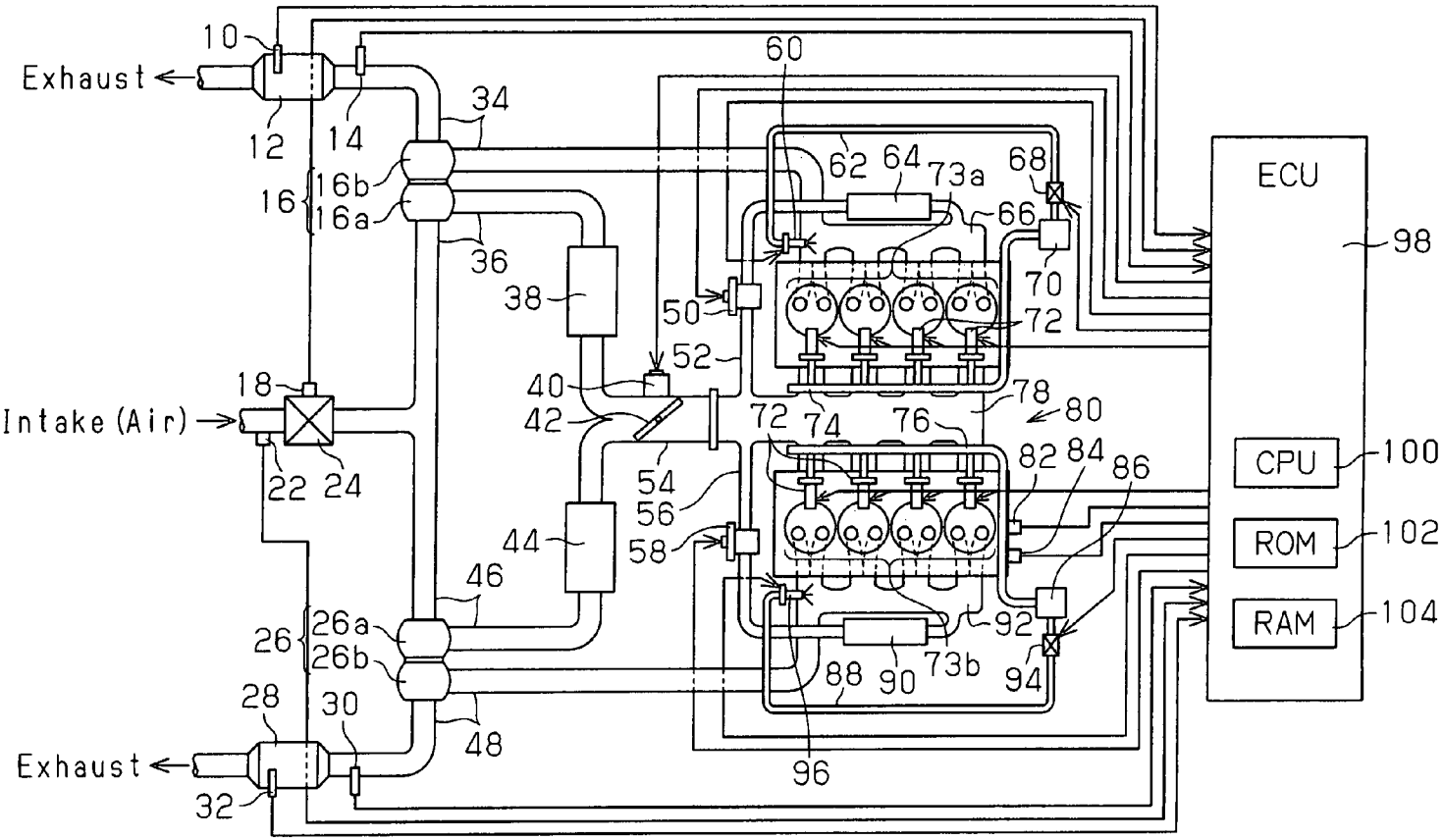
FIG. 1 is a schematic diagram showing the entire structure of an engine system.

As shown in FIG. 1, an engine system includes a diesel engine 80 and an electronic control unit (ECU) 98 for electronically controlling the diesel engine 80.

The diesel engine 80 is an eight cylinder engine having two cylinder banks 73*a* and 73*b*. Each of the cylinder banks 73*a* and 73*b* include four cylinders arranged along a straight line. The diesel engine 80 further includes an intake manifold 78 and two exhaust manifolds 66 and 92.

A fuel injection nozzle (injectors) 72, which functions as a fuel injection valve for injecting fuel into a combustion chamber, is attached to each cylinder. A coolant temperature sensor 84 for detecting the coolant temperature and an engine speed sensor 82, which functions as a second detector for detecting the engine speed, are attached to the diesel engine 80. For example, a resolver or an encoder may be used as the engine speed sensor 82. The coolant temperature sensor 84 and the engine speed sensor 82 are connected to the ECU 98, which function as a controller. Signals output from the sensors 82 and 84 are retrieved by the ECU 98.

The diesel engine 80 includes two fuel pumps 70 and 86. The fuel pumps 70 and 86 are each connected to a fuel tank (not shown). The fuel discharged from the fuel pumps 70 and 86 is supplied to the fuel injection nozzles 72 of the cylinder banks 73*a* and 73*b* via common rails 74 and 76, respectively.

The fuel pumps 70 and 86 each include a pump pulley. The diesel engine 80 has an output shaft connected to a crank pulley. A belt connects the pump pulleys of the fuel pumps 70 and 86 and the crank pulley of the diesel engine 80 are connected. Thus, when the diesel engine 80 is driven, power (rotary torque) is transmitted to the fuel pumps 70 and 86 by the belt thereby activating the fuel pumps 70 and 86. The ECU 98 varies the open degree of the opening and closing timing of each fuel injection nozzle 72 in accordance with the operational state of the diesel engine 80 to control the amount of fuel injected from each fuel injection nozzle 72.

The intake system of the diesel engine 80 will now be described in detail.

Each cylinder of the diesel engine 80 has an intake port (not shown). The intake manifold 78 is connected to the intake ports of the two cylinder banks 73*a* and 73*b*. A collective intake pipe 54 is connected to the intake manifold 78. A throttle valve 42 is arranged in the collective intake pipe 54. The collective intake pipe 54 is branched into two intake pipes 36 and 46. Ambient air (hereinafter referred to as intake air) is drawn into the combustion chamber of each cylinder in the two cylinder banks 73*a* and 73*b* through the corresponding intake pipes 36 and 46, the collective intake pipe 54, and the intake manifold 78.

An actuator 40 is connected to the throttle valve 42. For example, a step motor or a solenoid is used as the actuator 40. The actuator 40 is connected to the ECU 98. The ECU 98 sends a signal to the actuator 40 to activate the actuator 40 and control the opening degree and the opening and closing of the throttle valve 42. Compressors 16*a* and 26*a* and intercoolers 38 and 44 are arranged in the intake pipe 36 and 46, respectively. The intake pipes 36 and 46 are connected to an air cleaner 24 for removing dust from the intake air.

An airflow meter 18 for detecting the flow rate of the air flowing through the intake pipes 36 and 46 is arranged on the air cleaner 24. The airflow meter 18 is connected to the ECU 98. The airflow meter 18 outputs a signal retrieved by the ECU 98. The intake air is compressed by the compressors 16*a* and 26*a* after passing through the air cleaner 24. After being compressed and heated by the compressors 16*a* and 26*a*, the intake air is cooled by the intercoolers 38 and 44. An atmospheric sensor 22, which functions as a first detector, is arranged at the inlet of the intake pipes 36 and 46. The atmospheric sensor 22 is connected to the ECU 98. The atmospheric sensor 22 outputs a signal retrieved by the ECU 98.

The exhaust system of the diesel engine 80 will now be described in detail.

Each cylinder of the diesel engine 80 has an exhaust port (not shown). The first exhaust manifold 66 is connected to the exhaust port of each cylinder in the first cylinder bank 73*a*, and the second exhaust manifold 92 is connected to the exhaust port of each cylinder in the second cylinder bank 73*b*. The exhaust emitted from each cylinder of the first cylinder bank 73*a* is sent to the exhaust pipe 34 through the first exhaust manifold 66. The exhaust emitted from each cylinder of the second cylinder bank 73*b* is sent to the exhaust pipe 48 through the second exhaust manifold 92.

Reducing agent injection nozzles 60 and 96 are connected to the exhaust manifold 66 and 92, respectively. The reducing agent injection nozzles 60 and 96 each have an injection port facing into the corresponding exhaust manifolds 66 and 92. The reducing agent injection nozzles 60 and 96 are connected to the fuel pumps 70 and 86 through reducing agent supply pipes 62 and 88, respectively. The fuel discharged from the fuel pumps 70 and 86 is supplied to the fuel injection nozzles 72 through the common rails 74 and 76 and also supplied to the reducing agent injection nozzles 60 and 96 through the reducing agent supply pipe 62 and 88.

Valves 68 and 94 are arranged in the reducing agent supply pipes 62 and 88, respectively. The reducing agent injection nozzles 60 and 96 and the valves 68 and 94 are connected to the ECU 98. The reducing agent injection nozzles 60 and 96 each inject the fuel supplied from the corresponding fuel pumps 70 and 86 to the corresponding exhaust manifolds 66 and 92 based on the signal output from the ECU 98. In this case, the fuel injected from the reducing agent injection nozzles 60 and 96 is used as a reducing agent for suppressing the generation of PM and unburned gas.

Turbines 16*b* and 26*b* and filters 12 and 28 are arranged in the two exhaust pipes 34 and 48, respectively. The exhaust pipes 34 and 48 function as an exhaust passage. Flow rate sensors 14 and 30 for detecting the flow rate of the exhaust are attached to the exhaust pipes 34 and 48, respectively. The flow rate sensors 14 and 30 are each connected to the ECU 98. The flow rate sensors 14 and 30 each output a signal, which is retrieved by the ECU 98. The first turbine 16*b* forms a first supercharger 16 with the compressor 16*a*, and the second turbine 26*b* forms a second supercharger 26 with the compressor 26*a*. The exhaust flowing through the exhaust pipe 34 rotates the first turbine 16*b*. This activates the compressor 16*a* connected to the turbine 16*b* and compresses the intake air flowing through the intake pipe 36. In the same manner, the exhaust flowing through the exhaust pipe 48 rotates the second turbine 26*b*. This activates the compressor 26*a* connected to the second turbine 26*b* and compresses the intake air flowing through the intake pipe 46. The filters 12 and 28 each contain, for example, a NOx occlusion reduction type catalyst. Each of the filters 12 and 28 collects PM and unburned gas (carbon hydride etc.) and undergoes regeneration. Temperature sensors 10 and 32 for detecting the temperature of the filters 12 and 28 are attached to the filters 12 and 28, respectively. The temperature sensors 10 and 32 are each connected to the ECU 98 and produces a signal retrieved by the ECU 98.

Two exhaust gas recirculation (EGR) passages 52 and 56 for respectively connecting the exhaust manifolds 66 and 92 to the intake manifold 78 are arranged in the diesel engine 80. The EGR passages 52 and 56 circulate some of the exhaust so that the exhaust is returned to each cylinder as intake air. The EGR passages 52 and 56 include EGR coolers 64 and 90 and EGR valves 50 and 58, respectively. The EGR coolers 64 and 90 cool the exhaust (hereinafter referred to as EGR gas) flowing through the corresponding EGR passages 52 and 56. A coolant passage (not shown) extends through each of the EGR coolers 64 and 90 for circulation of coolant, which cools the diesel engine 80. When using, for example, electromagnetic valves as the EGR valves 50 and 58, the opening degree of each of the EGR valves 50 and 58 is controlled in accordance with the applied power to adjust the flow rate of the EGR gas.

The ECU 98 will now be described.

The ECU 98 includes a CPU 100, a storage means such as a ROM 102 and a RAM 104, and a circuit for inputting and outputting signals. Programs, various maps, and the like for executing a control process for ensuring the air amount quantity are stored in the ROM 102. The ECU 98 retrieves the signals output from the airflow meter 18, the atmospheric sensor 22, the temperature sensors 10 and 32, the flow rate sensors 14 and 30, the engine speed sensor 82, and the coolant temperature sensor 84 to execute various controls based on the retrieved signals.

The ECU 98 outputs a signal to each fuel injection nozzle 72 and executes control related to the injection of fuel from each cylinder. Furthermore, the ECU 98 outputs signals to the valves 68 and 94 and the reducing agent injection nozzle 60 and 96 to suppress the generation of PM and unburned gas and execute control related to the injection of fuel (reducing agent) to the exhaust manifolds 66 and 92.

The air amount ensuring control process performed during the regeneration process of the filter in the engine system will now be described with reference to FIG. 2. The control process is repeatedly executed during the regeneration process of the filter.

Figure 2:
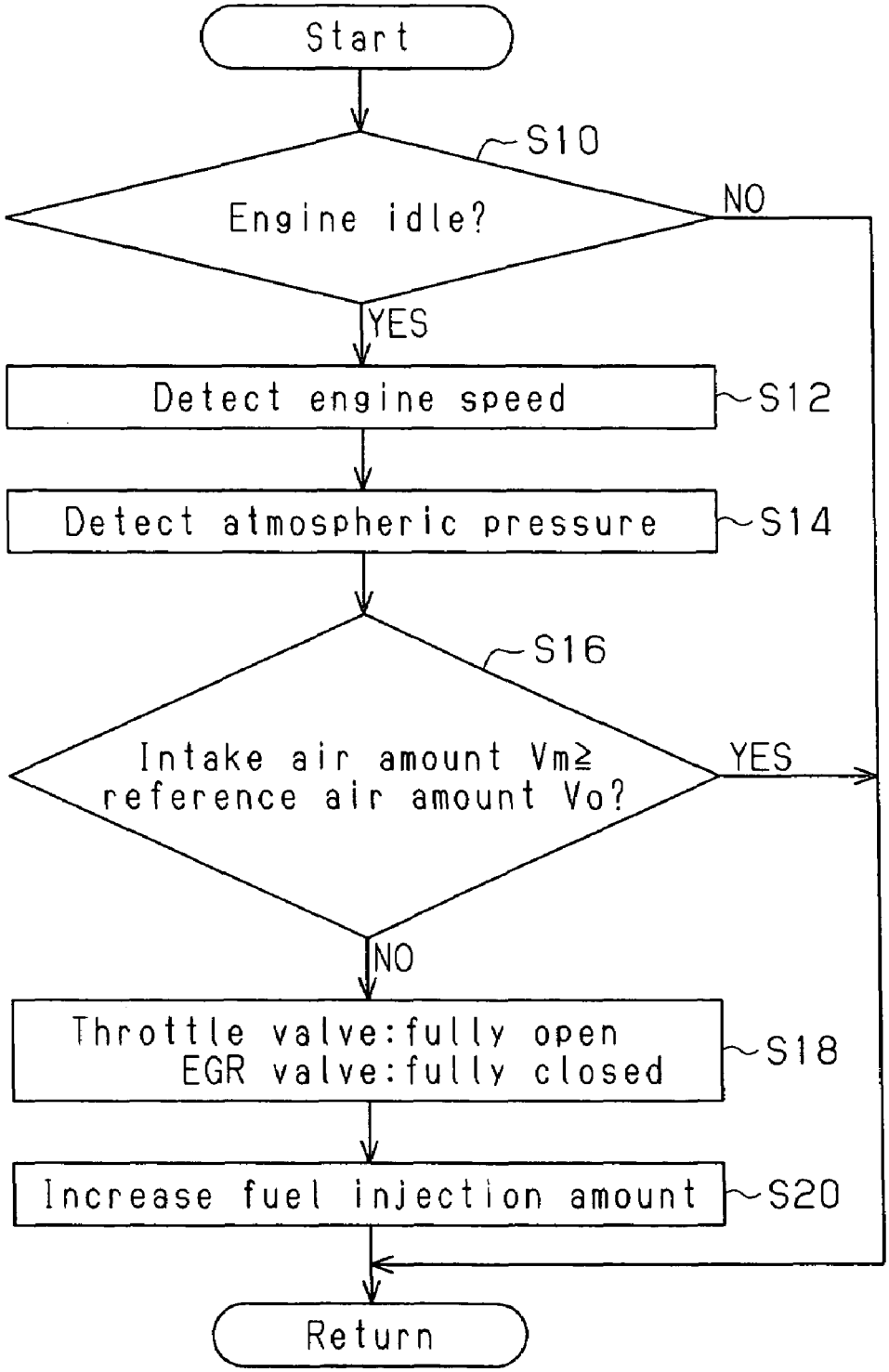
FIG. 2 is a flowchart showing a control process for ensuring the intake air amount according to a preferred embodiment of the present invention.

In the control process for ensuring the air amount, the ECU 98 first determines whether or not the diesel engine 80 is currently operating in an idle state (step S10), as shown in FIG. 2. If the diesel engine 80 is not currently operating in the idle state (NO in step S10), the ECU 98 terminates the process. If the diesel engine 80 is currently operating in the idle state (YES in step S10), the ECU 98 determines the engine speed Ne based on the signal from the engine speed sensor 82 (step S12) and determines the atmospheric pressure Pi based on the signal from the atmospheric sensor 22 (step S14).

The ECU 98 reads the intake air amount Vm based on the detected engine speed Ne and atmospheric pressure Pi for when the throttle valve 42 is completely opened and the EGR valve 50 and 58 are completely closed from the map stored in advance in the ROM 102. The ECU 98 compares the intake air amount Vm with the intake air amount (hereinafter referred to as reference air amount V0) necessary to prevent the occurrence of deceleration OT. If the intake air amount Vm is greater than the reference air amount V0 (YES in step S16), the ECU 98 executes an opening degree control on the throttle valve 42 and the EGR valves 50 and 58. The ECU 98 terminates the process when the intake air amount is greater than or equal to the reference air amount V0.

When the intake air amount Vm is less than the reference air amount V0 (NO in step S16), the ECU 98 completely opens the throttle valve 42 and completely closes the EGR valves 50 and 58 (step S18). The ECU 98 then performs idle-up for increasing the idle speed of the engine by increasing the fuel injection amount (step S20). The ECU 98 then terminates the process. In step S20, the fuel injection amount (engine speed) for idle-up is obtained from an atmospheric pressure Pi-idle up amount (injection amount) map, which is obtained in advance through experiments or the like.

The preferred embodiment has the advantages described below.

The ECU 98 obtains the intake air amount Vm based on the detected atmospheric pressure Pi and engine speed Ne from the map. When the intake air amount Vm is less than the reference air amount V0, the ECU 98 completely opens the throttle valve 42 and completely closes the EGR valves 50 and 58. The ECU 98 then performs idle-up by increasing the fuel injection amount. This maximizes the intake air amount and increases the fuel injection amount. Thus, the engine speed increases, and the two compressors 16*a* and 26*a* increase the intake air amount. This ensures that the intake air amount is greater than or equal to the reference air amount V0 when filter temperature increase control is being executed and prevents the occurrence of deceleration OT even under low pressure environments such as at high altitudes.

It should be apparent to those skilled in the art that the present invention may be embodied in many other specific forms without departing from the spirit or scope of the invention. Particularly, it should be understood that the present invention may be embodied in the following forms.

In the preferred embodiment, only one value is taken at a predetermined timing for each of the detected atmospheric pressure Pi and the detected engine speed Ne. However, average values, which are obtained by sampling a plurality of values during a predetermined period, may be used as the atmospheric pressure Pi and the engine speed Ne. In this case, in steps S12 to S14 shown in FIG. 2, the average values of the atmospheric pressure Pi and the engine speed Ne are obtained by sampling the atmospheric pressure Pi and the engine speed Ne during a predetermined period, adding the sampled detection values, and dividing the sum by the number of samplings. The intake air amount Vm and the reference air amount V0 are compared in step S16 with the average values. This smoothes the control for ensuring the intake air amount even if the atmospheric pressure Pi and the engine speed Ne greatly fluctuates.

In the preferred embodiment, the atmospheric pressure Pi is the only variable if the idle speed is constant. In this case, the relational expression of step S16 in FIG. 2 may be simplified to a relational expression for comparing the atmospheric pressure Pi and the reference pressure.

Figure 3:
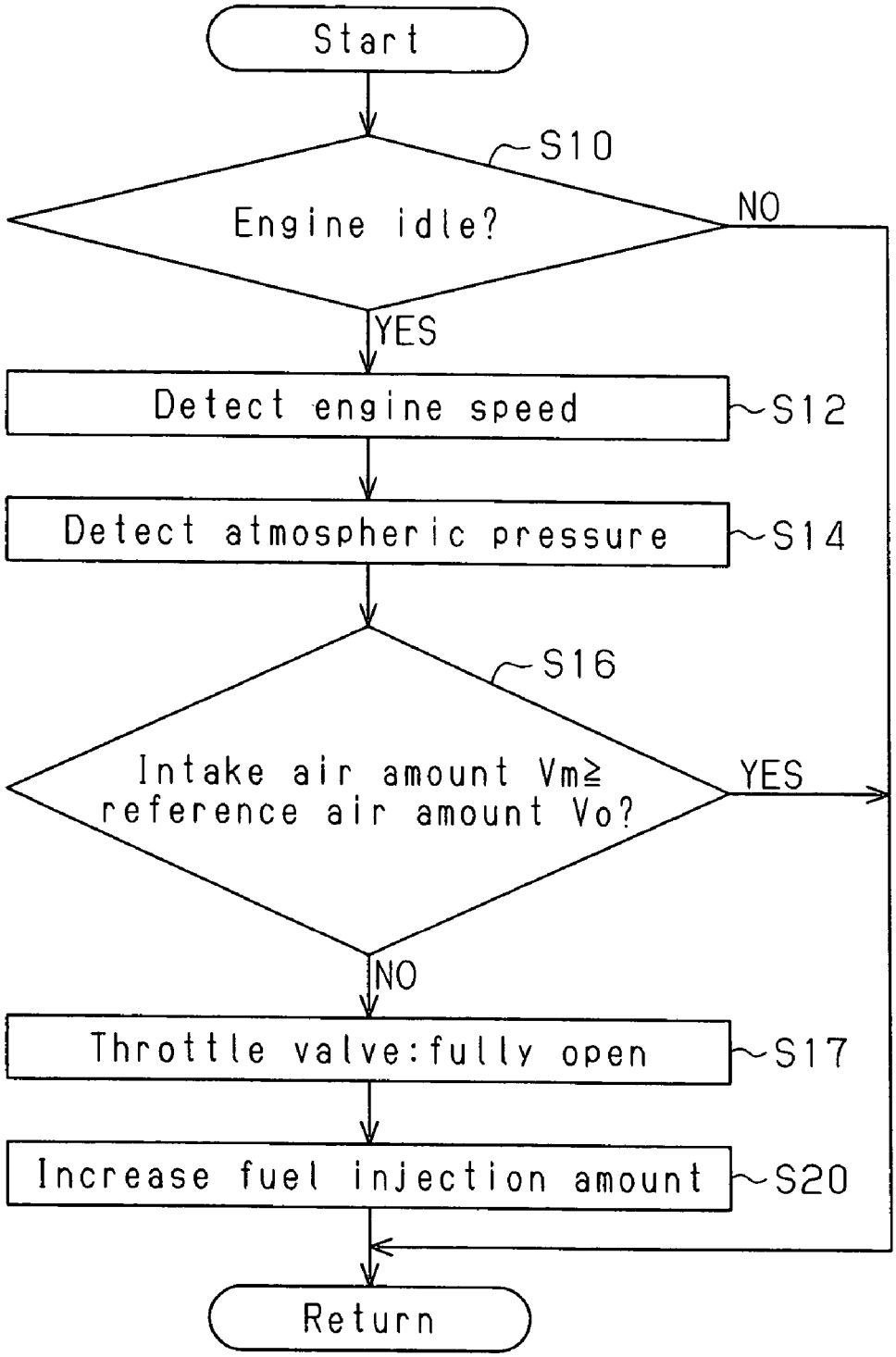
FIG. 3 is a flowchart showing a modified control process for ensuring the intake air amount.

In the preferred embodiment, step S18 of FIG. 2 may be changed to step S17 as shown in FIG. 3 to completely open only the throttle valve 42.

If the difference between the intake air amount Vm and the reference air amount Vo is small in the determination of step S16, it is preferable not to completely open the throttle valve 42 and completely close the EGR valves 50 and 58 since this would suddenly change the intake air amount. Thus, only the throttle valve 42 may first be completely opened and the subsequent processes may be performed based on the determination of step S16 in the next cycle. For example, the embodiment shown in FIG. 3 and the embodiment shown in FIG. 2 may both be performed. That is, if determined as "NO" in step S16, only the throttle valve 42 is first completely opened. If the determination of step S16 is still "NO" even after a predetermined time elapses, the EGR valves 50 and 58 may be completely closed to increase the fuel injection amount.

Figure 4:
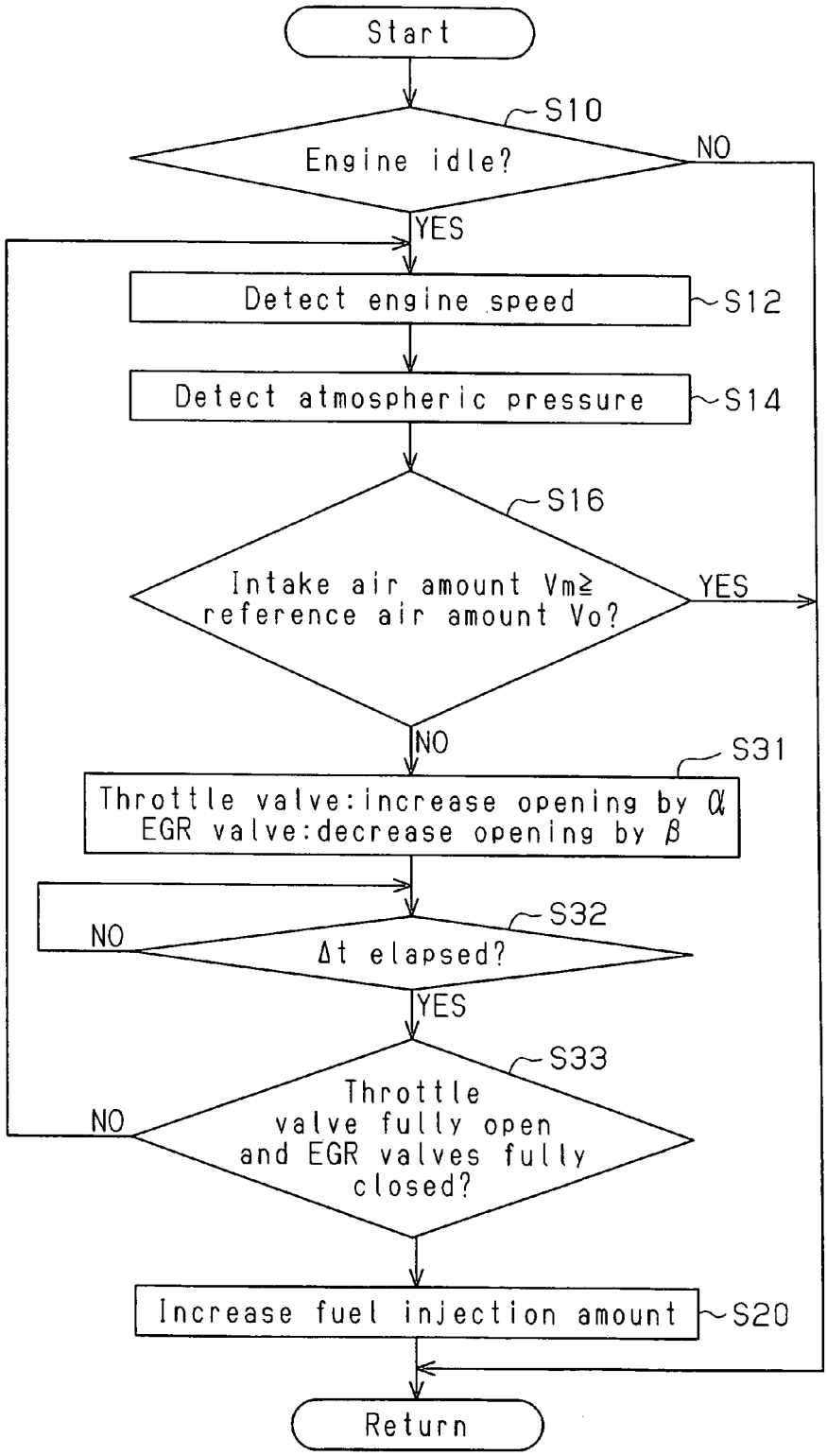
FIG. 4 is a flowchart showing another modified control process for ensuring the intake air amount.

Furthermore, referring to FIG. 4, the throttle valve 42 may gradually be opened and the EGR valves 50 and 58 may be gradually closed over a predetermined time taking into account fluctuations in the detected atmospheric pressure Pi and engine speed Ne in step S18 of FIG. 2. In the flowchart shown in FIG. 4, the same reference characters are denoted for steps that are identical to those in the flowchart shown in FIG. 2.

In the embodiment shown in FIG. 4, if the intake air amount Vm becomes less than the reference air amount V0 in step S16 (NO in step S16), the current opening degree of the throttle valve 42 is increased by $\alpha$ (0 to 1.0) and the current opening degree of the EGR valves 50 and 58 is decreased by $\beta$ (0 to 1.0) (step S31).

After a predetermined time $\Delta t$ elapses (step S32), the ECU 98 determines (step S33) whether or not the throttle valve 42 is completely open and the EGR valves 50 and 58 are completely closed. If the throttle valve 42 is not completely open and the EGR valves 50 and 58 are not completely closed (NO in step S33), the ECU 98 returns to step S12 and detects the atmospheric pressure Pi and the engine speed Ne. The ECU 98 then determines whether or not the condition of step S16 is satisfied.

In this manner, the ECU 98 determines whether or not the condition of step S16 is satisfied whenever the predetermined time $\Delta t$ elapses. In this case, fluctuations in the detected atmospheric pressure Pi and engine speed Ne may be coped with in a satisfactory manner. That is, even if the detected atmospheric pressure Pi and the engine speed Ne do not temporarily satisfy the condition of step S16 but satisfy the condition after the next $\Delta t$ (predetermined time) elapses (YES in step S16), the normal fuel injection control is executed without increasing the fuel injection amount. If step S33 is YES, the ECU 98 increases the fuel injection amount and terminates the process (step S33).

As described above, the fuel injection amount may gradually be increased without suddenly completely opening the throttle valve 42 or suddenly completely closing the EGR valves 50 and 58 by detecting the atmospheric pressure Pi and the engine speed Ne and determining whether or not the relational expression of step S16 is satisfied whenever the predetermined time Δt elapses. Thus, for example, slight fluctuations in the atmospheric pressure Pi may be coped with in a satisfactory manner. In step S17 of the control process shown in FIG. 3, the throttle valve 42 may be gradually opened over a predetermined time until it completely opens.

In the preferred embodiment, the flow rate sensors 14 and 30 may be omitted.

The present invention may be applied to an engine that does not have either the throttle valve 42 or the EGR valves 50 and 58. In an engine that does not have the throttle valve and the EGR valves, the reference air amount V0 is obtained from the engine speed Ne and the atmospheric pressure Pi.

The present invention is embodied in the eight cylinder diesel engine 80. However, the present invention may also be embodied, for example, in an inline four cylinder engine or six cylinder engine. In this case, the occurrence of deceleration OT is more effectively suppressed since the required engine speed decreases as the number of cylinders increases.

The present examples and embodiments are to be considered as illustrative and not restrictive, and the invention is not to be limited to the details given herein, but may be modified within the scope and equivalence of the appended claims.

The invention claimed is:

1. An exhaust purifier for a diesel engine having an exhaust passage and an intake passage, the exhaust purifier comprising:

a filter arrangeable in the exhaust passage of the diesel engine;

a first detector for detecting atmospheric pressure;

a controller for controlling the engine speed of the diesel engine;

a second detector for detecting the engine speed of the diesel engine;

a throttle valve arrangeable in the intake passage of the diesel engine; and an EGR valve for opening and closing a fluid communication path between the intake passage and the exhaust passage;

wherein the diesel engine includes a fuel injection valve, and the controller is further configured to:

perform idle-up by increasing the amount of fuel injected from the fuel injection valve of the diesel engine, compare an intake air amount, which is based on the atmospheric pressure detected by the first detector and the engine speed detected by the second detector, with a reference air amount during regeneration of the filter;

perform idle-up for increasing the idle speed of the diesel engine when the intake air amount is less than the reference air amount; and increase the fuel injection amount if the intake air amount, which is based on the atmospheric pressure detected by the first detector and the engine speed detected by the second detector, is less than the reference air amount when the throttle valve is completely open and the EGR valve is completely closed during the regeneration of the filter.

2. The exhaust purifier according to claim 1, wherein the controller increases the fuel injection amount by completely opening the throttle valve and completely closing the EGR valve.

3. The exhaust purifier according to claim 1, wherein the controller first completely opens only the throttle valve and then completely closes the EGR valve after a predetermined time elapses when the intake air amount is less than the reference air amount.

4. The exhaust purifier according to claim 1, wherein the controller opens the throttle valve by a predetermined amount and closes the EGR valve by a predetermined amount whenever a predetermined time elapses.

5. The exhaust purifier according to claim 1, further comprising:

a reducing agent injection valve for injecting fuel of the diesel engine as a reducing agent into an exhaust manifold of the diesel engine.

6. The exhaust purifier according to claim 5, wherein fuel is supplied to the fuel injection valve and the reducing agent injection valve from a common fuel pump.

7. The exhaust purifier according to claim 1, wherein the filter contains an occlusion reduction type catalyst.

8. The exhaust purifier according to claim 1, wherein the diesel engine is a multiple cylinder diesel engine.

9. The exhaust purifier according to claim 8, wherein the diesel engine is an eight cylinder engine.

10. The exhaust purifier according to claim 1, wherein the intake air amount is obtained based on an average value of the atmospheric pressure, sampled during a predetermined period by the first detector, and an average value of the engine speed, sampled during a predetermined time by the second detector.

11. The exhaust purifier according to claim 1, wherein the controller compares the intake air amount and the reference air amount whenever a predetermined time elapses.

* * * * *